US006126253A

United States Patent [19]

Kelley et al.

[11] Patent Number: 6,126,253

[45] Date of Patent: Oct. 3, 2000

[54] COMPUTER DESK

[75] Inventors: James O. Kelley, Spring Lake; Ralph J. Byma, Zeeland; Gregg J. Persons, Wyoming, all of Mich.

[73] Assignee: Sligh Furniture Company, Holland, Mich.

[21] Appl. No.: 08/840,959

[22] Filed: Apr. 17, 1997

[51] Int. Cl.[7] ..... A47B 17/00

[52] U.S. Cl. ..... 312/195; 312/311; 312/223.3

[58] Field of Search ..... 312/195, 223.3, 312/223.2, 317.3, 208.1, 194, 311, 348.4

[56] References Cited

U.S. PATENT DOCUMENTS

| | | | |
|---|---|---|---|
| 227,179 | 5/1880 | Robbins | 312/311 X |
| 1,409,871 | 3/1922 | Leatherman | 312/311 X |
| 1,463,289 | 7/1923 | Mitchell | 312/311 X |
| 1,788,328 | 1/1931 | Roberts | 312/194 X |
| 2,155,048 | 4/1939 | Hupp | 312/194 |
| 2,224,020 | 12/1940 | Jones et al. | 312/311 X |
| 2,498,243 | 2/1950 | Brinker et al. | 312/311 X |
| 3,558,204 | 1/1971 | Elliot | 312/208.1 |
| 4,390,006 | 6/1983 | Kowk | 312/311 X |
| 4,755,009 | 7/1988 | Price et al. | 312/223.3 |
| 4,763,965 | 8/1988 | Reppel | 312/223.3 |
| 4,786,119 | 11/1988 | Smuda | 312/195 |
| 5,558,418 | 9/1996 | Lambright et al. | 312/223.3 X |
| 5,562,332 | 10/1996 | Stacy | 312/194 X |
| 5,632,540 | 5/1997 | Wilcox | 312/204 X |
| 5,741,053 | 4/1998 | Nielsen | 312/195 X |
| 5,743,603 | 4/1998 | Kelley et al. | 312/195 |
| 5,842,758 | 12/1998 | Kelley | 312/223.3 X |

FOREIGN PATENT DOCUMENTS

| | | | |
|---|---|---|---|
| 3342245 | 5/1985 | Germany | 312/223.3 |
| 509262 | 7/1939 | United Kingdom | 312/317.3 |
| 2143429 | 2/1985 | United Kingdom | 312/194 |
| 2172498 | 9/1986 | United Kingdom | 312/223.3 |

*Primary Examiner*—Peter M. Cuomo
*Assistant Examiner*—David E. Allred
*Attorney, Agent, or Firm*—Waters & Morse, P.C.

[57] ABSTRACT

A computer desk has a work surface with a first support connected with the work surface near a first end to support the work surface above a floor, and a second support releasably connected with the work surface near a second, opposing end. The second support has a top with a portion of the top spaced from the work surface to define a drawer space. A drawer extends from the first support toward the second end and into the drawer space. A kneehole is defined between the first and second support members and below the work surface. One of the support members may include a storage compartment with an interior and a door that opens and closes access to the interior. The door is spaced above the floor and the storage compartment has a removable panel that extends from the floor to at least a bottom of the door. The storage compartment may also include a saddle type storage drawer that is narrower than the storage compartment to define a space for a CPU tower in the storage compartment.

2 Claims, 7 Drawing Sheets

COMPUTER DESK

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to pedestal work desks for the office and for the home, and the like.

As is well known, computerization of various work tasks and of other various tasks of everyday life, continues to expand. Thus, the expanding appearance of computers and computerized appliances continues into all aspects of the work place and onto ever more desk tops. This does, however, present a problem for those who prefer to work at a traditionally styled work desk, such as a pedestal desk, for example. The problem may be stated in that computer equipment is not accommodated by traditional furniture styles. That is, a common installation of a computer with a conventional pedestal desk, or the like, is to place the monitor, keyboard, and pointing device (such as a mouse) upon the desk top or work surface, with the central processing unit stashed in the kneehole space to block a user's feet and legs. Such arrangements result in cluttered and inconvenient desk work spaces that often inhibit effective use of the computer technology, rather than allowing the technology to enhance the worker's organization and performance. Further, use of a keyboard and the like upon the desk top will commonly lead to user discomfort and even injury because the desk top is too high for proper use of the keyboard and pointing device. A common malady of such inappropriate equipment use is carpal tunnel syndrome, for example, which is proving to be very costly.

One may, then, understand a need to adapt traditional styled desks for integration and use of computers, and the like.

BRIEF SUMMARY OF THE INVENTION

A computer desk according to the invention addresses the problems that are discussed and suggested above, with a traditionally styled desk that has a front and an opposing back, first and second opposing ends, a work surface, a first support member or pedestal that is positioned near the first end, and a second support member or pedestal that is positioned near the second end. The first and the second support members extend between the front and the back, and extend generally downward from the work surface to support the work surface above a floor. The second support member has a top with a portion of the top being spaced from the work surface to define a drawer space. A drawer for a keyboard or the like extends from the first support toward the second end and into the drawer space, as defined between the top of the second support and the work surface. Further, a kneehole is defined between the first and second support members, between the front and the back, and underneath the work surface.

In further aspects of the invention, one of the support members includes a storage compartment. The storage compartment may include a door that opens to provide access into an interior of the storage compartment and that closes to conceal the storage compartment interior. The door has a bottom edge that is spaced above the floor, and the storage compartment includes a removable panel that extends at least between the floor and the door. In another aspect of the invention, the storage compartment may include a storage drawer that is slidably connected with the storage compartment to slide between a retracted position generally within the storage compartment, and an extended position, in which the drawer extends outward from the front of the desk. In yet another aspect of the invention, the second support member may be releasably connected with the work surface to facilitate moving the computer desk.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 6:
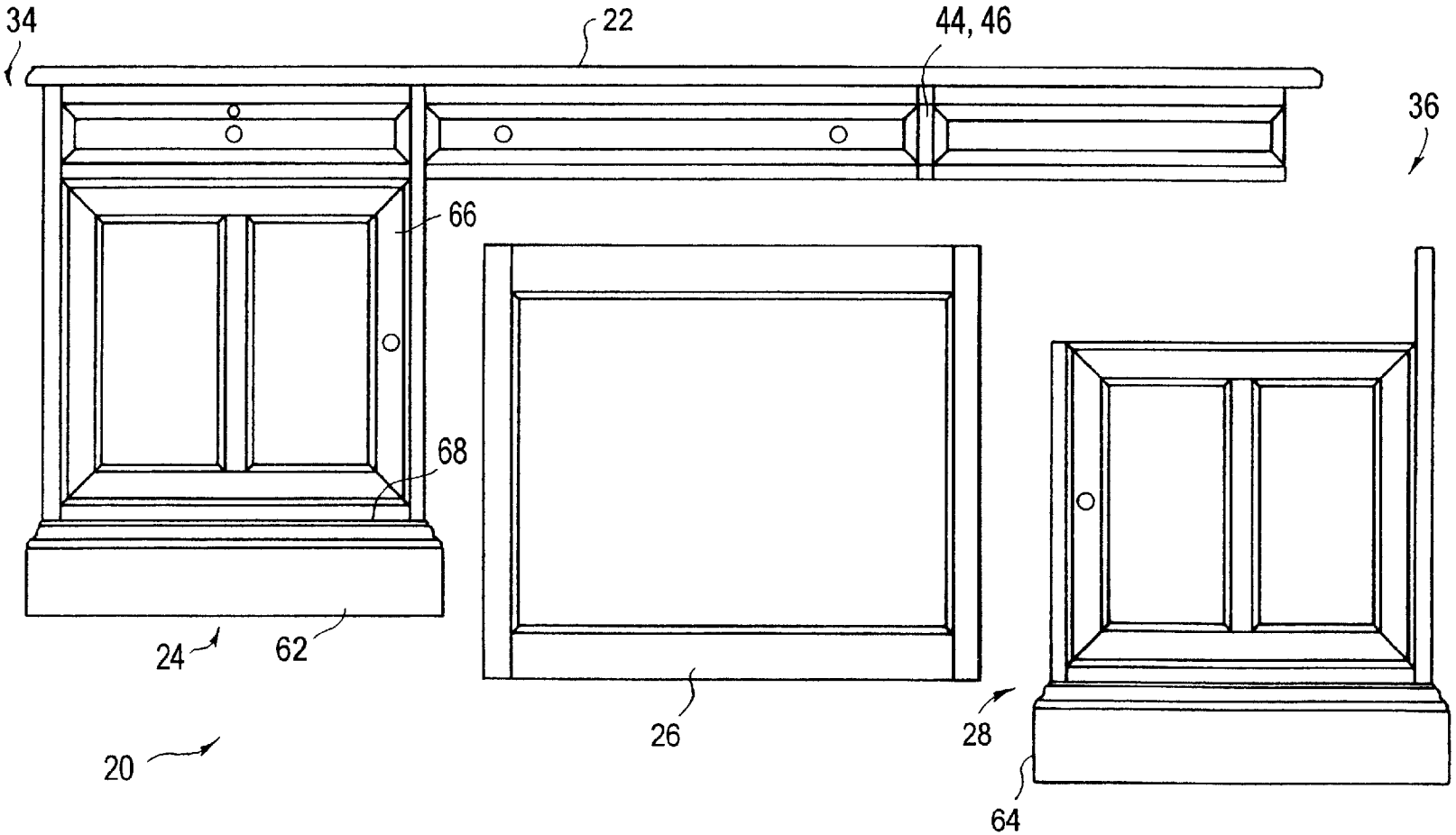
FIG. 6 is an exploded front elevational view thereof.

A computer desk according to the invention is generally shown throughout the several views of the drawing and identified by the reference number 20. For convenience in moving, the computer desk 20 can be disassembled into three component assemblies, including a work surface 22 with a first support pedestal 24, a vanity panel 26, and a second support pedestal 28 (FIG. 6).

Figure 1:
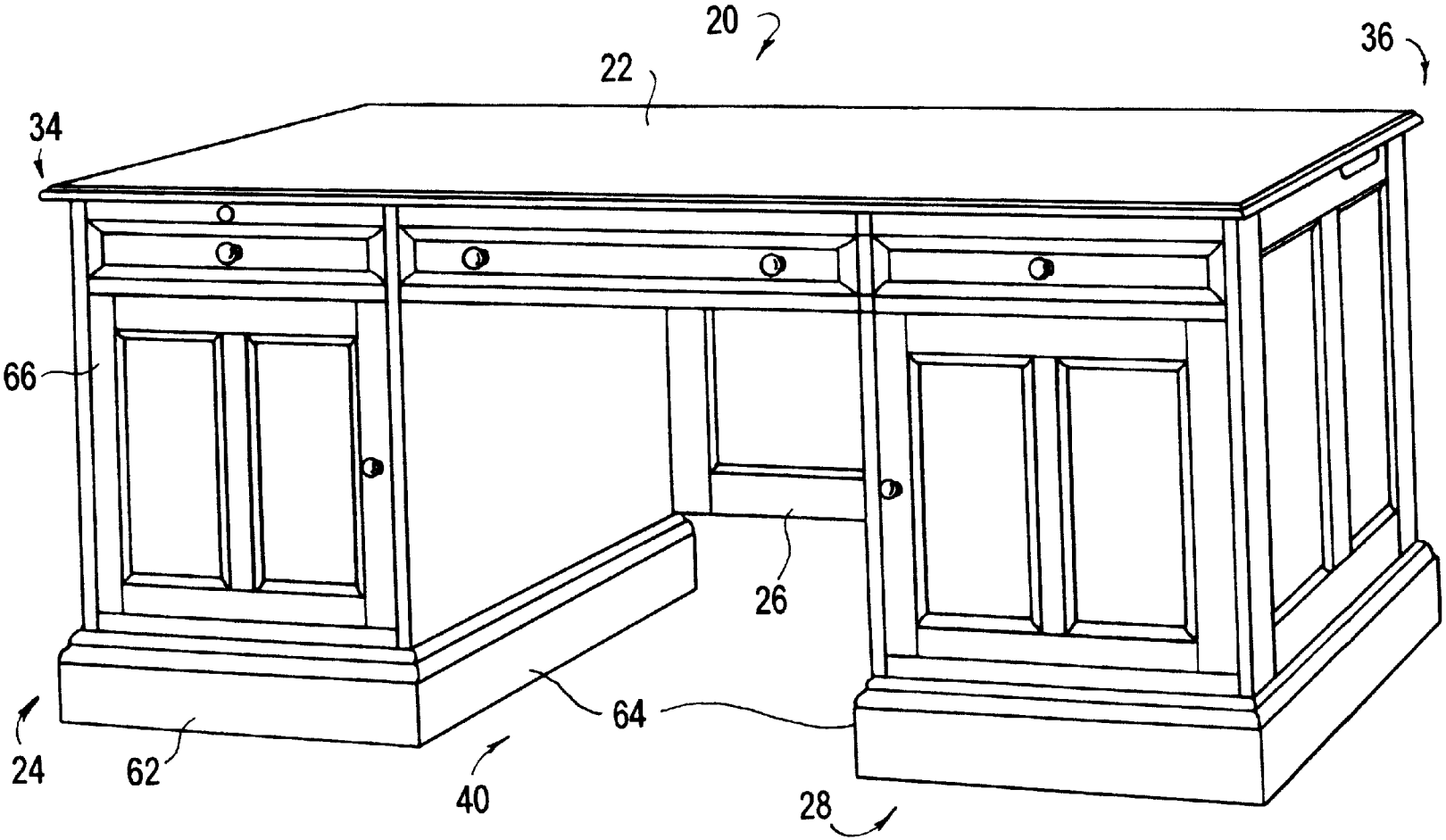
FIG. 1 is front perspective view of a computer desk according to the invention.
Figure 2:
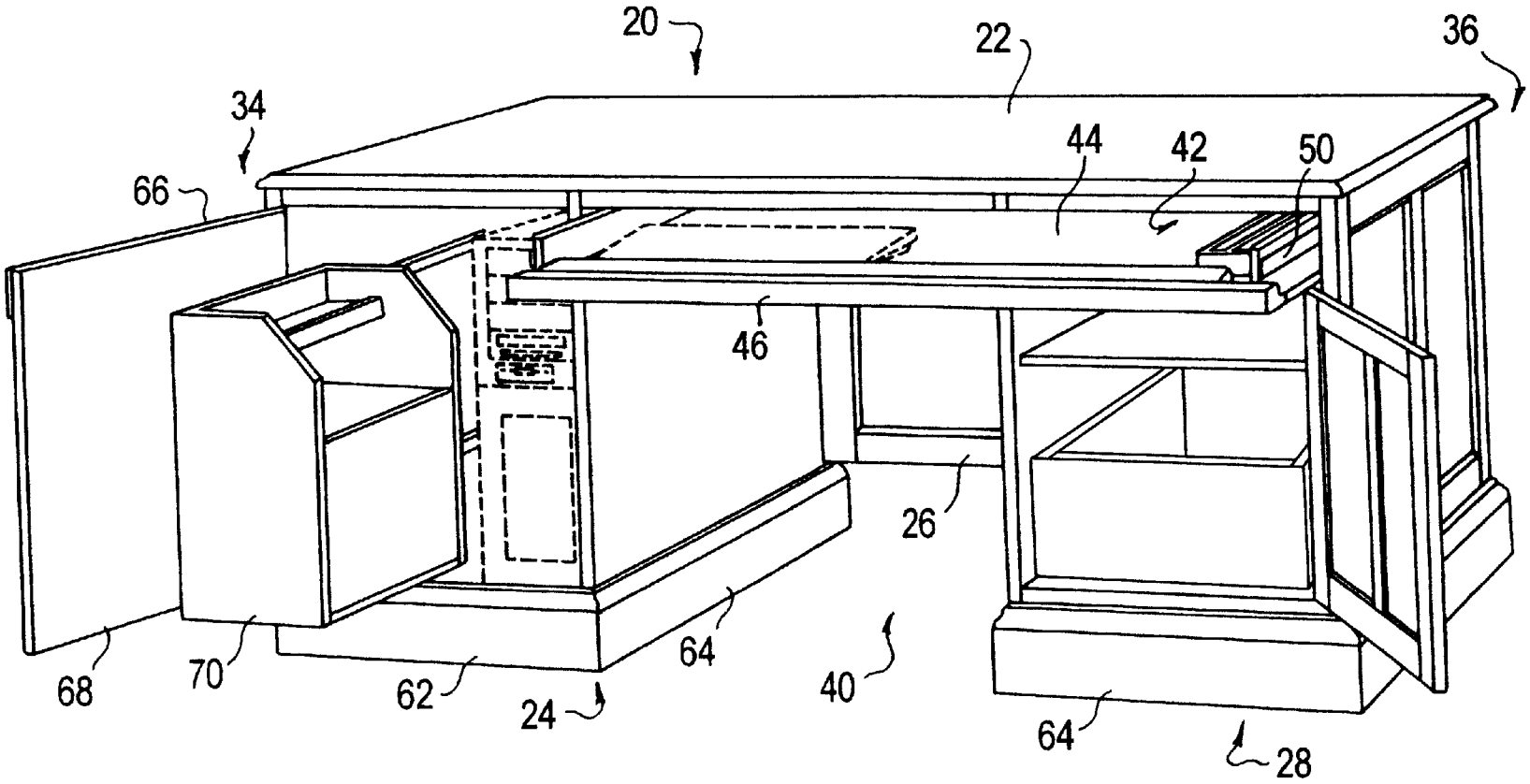
FIG. 2 is the view of FIG. 1, showing the doors and drawers open.
Figure 3:
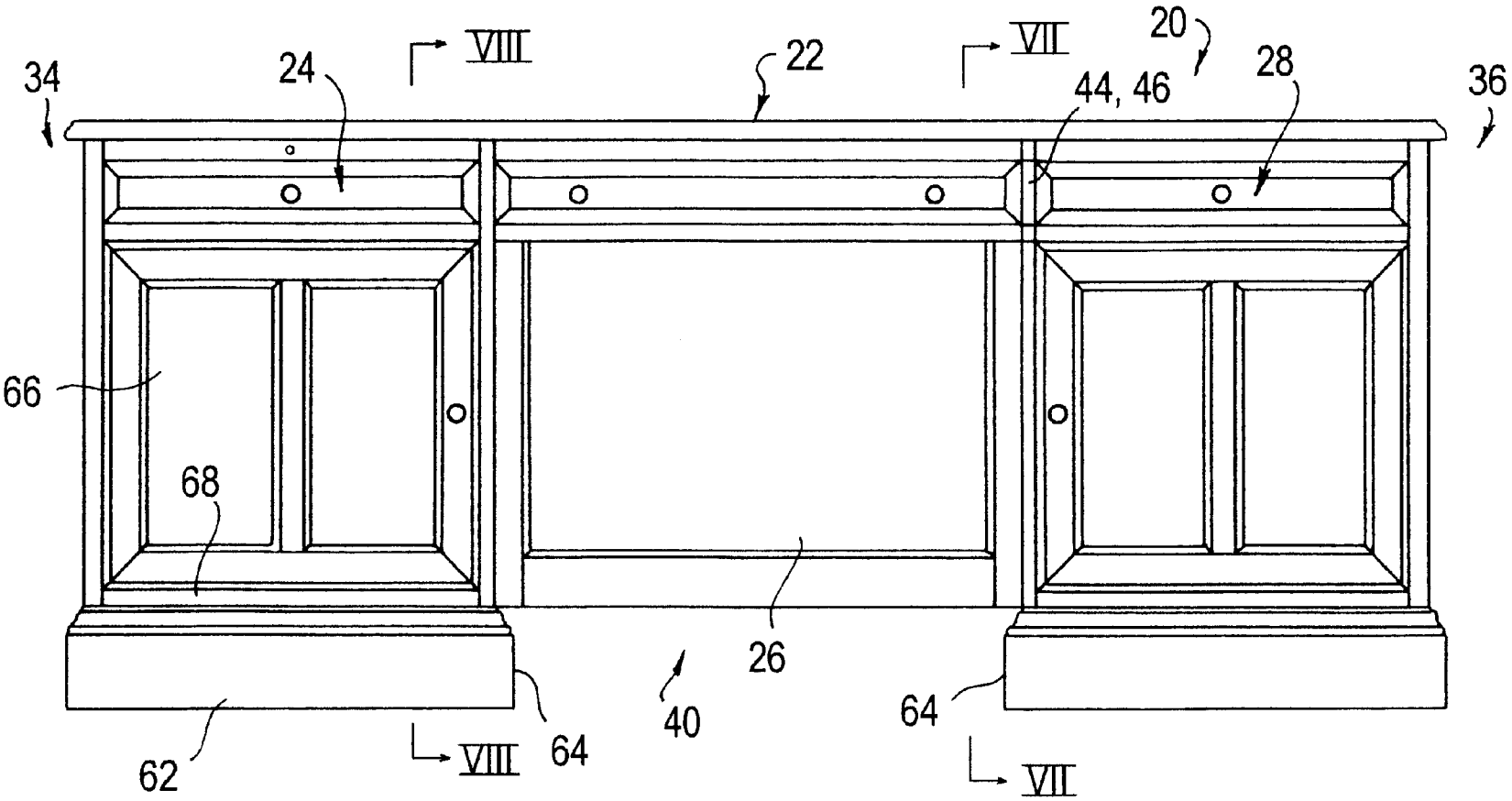
FIG. 3 is a front elevational view thereof.
Figure 4:
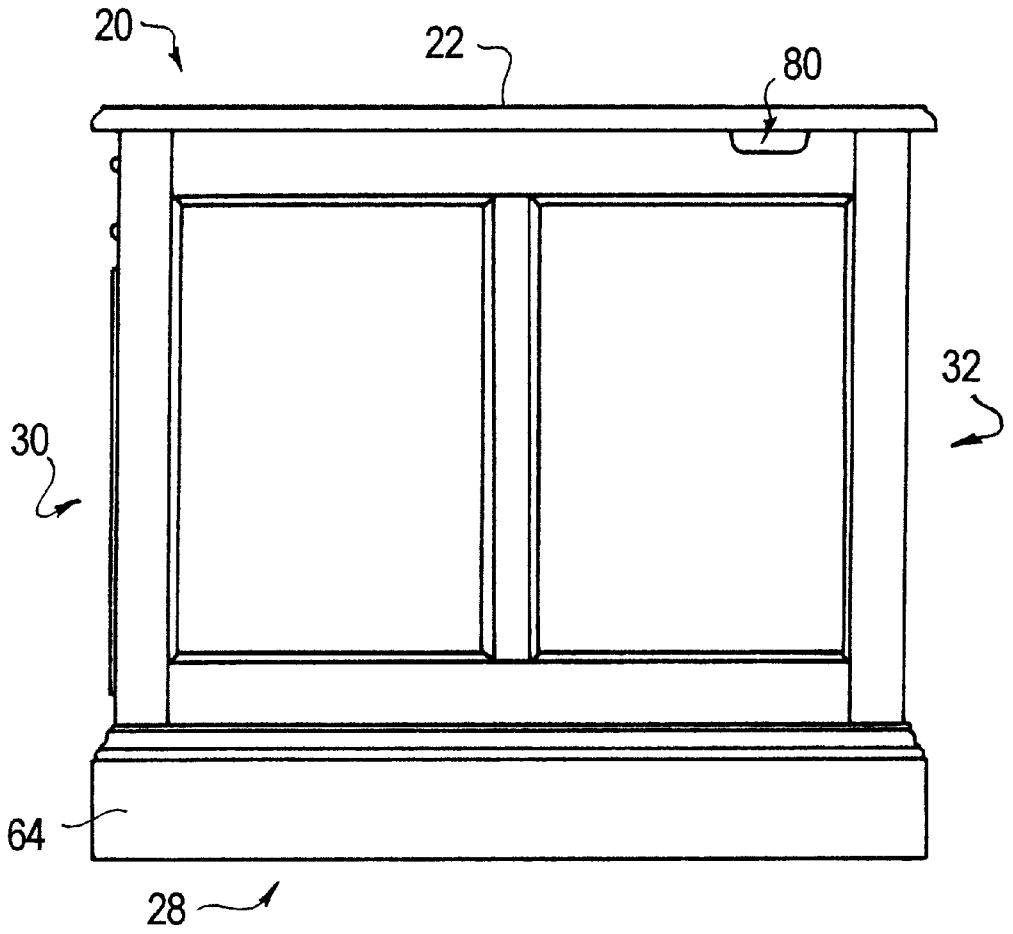
FIG. 4 is a right side elevational view thereof.
Figure 5:
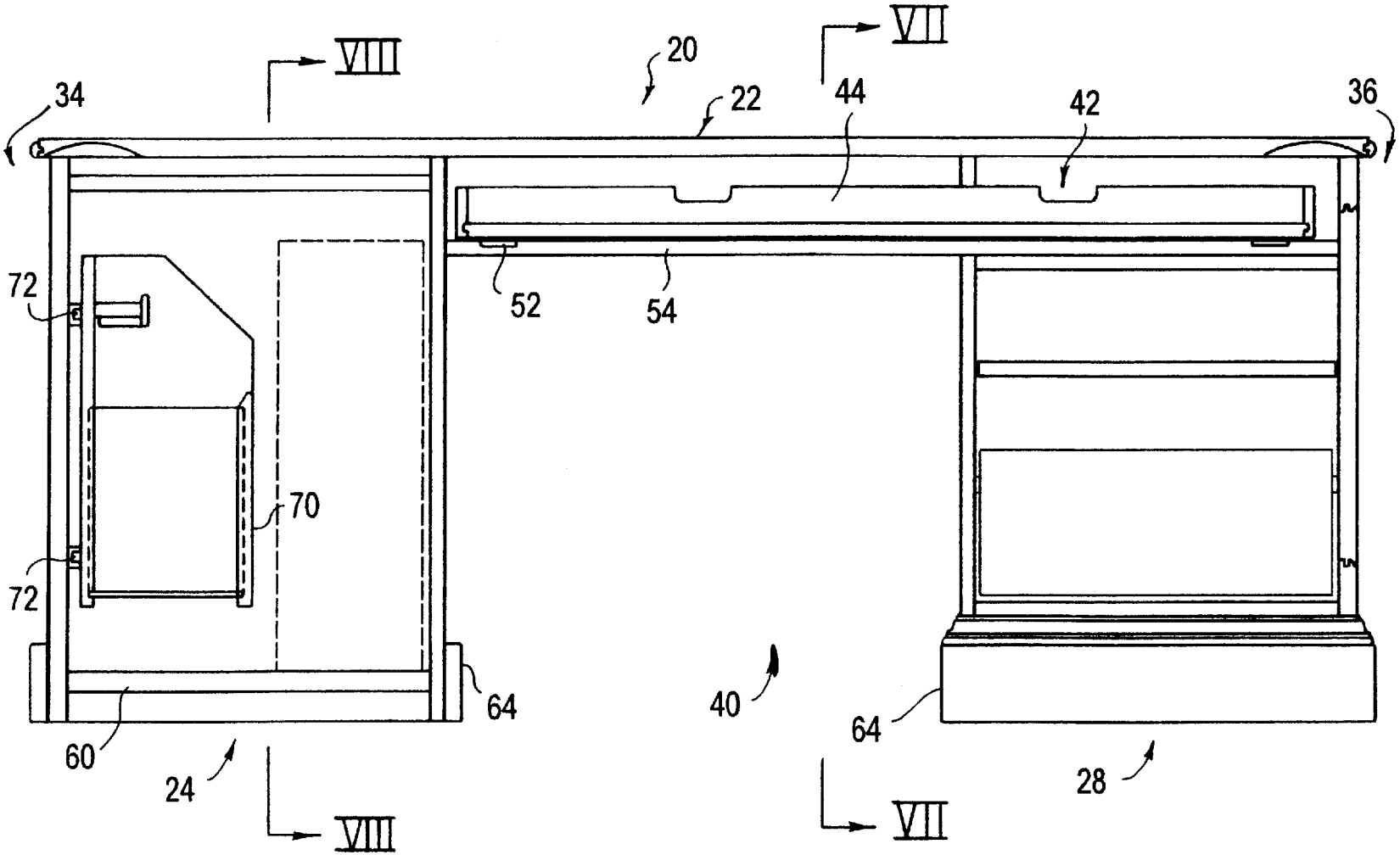
FIG. 5 is the view of FIG. 3 with the doors and drawer fronts removed.

When assembled, the computer desk 20 has a front 30 and an opposing back 32 and first 34 and second 36 opposing ends (FIG. 1). The work surface 22 is supported near the first end 34 by the first support member or pedestal 24 that extends between the front 30 and back 32 of the desk 20, and that extends generally downward from the work surface 22 to support the work surface above a floor. The second support member or pedestal 28 is positioned near the second end 36, and also extends between the front 30 and the back 32 of the desk 20, and extends generally downward from the work surface 22 to support the work surface above the floor. Thus, a kneehole 40 is defined between the first 24 and the second 28 support members, between the front 30 and the back 32, and underneath the work surface 22.

A portion of the top of the second pedestal is spaced from the work surface 22 to define a drawer space 42 under the work surface and above the second pedestal (FIGS. 1–3, 5, and 6). An extended width keyboard drawer 44 is slidably connected under the work surface 22 to slide between a closed position, generally under the work surface, and an open position, in which the drawer 44 extends from the front 30 of the desk 20. With a keyboard located in the drawer 44, under the work surface 22, the keyboard is positioned in an appropriate, typing position so the user may use the keyboard with preferably straight wrists, rather than with cocked wrists that typically result from "keying" with the keyboard positioned too high above a sitting user's lap.

The drawer 44 extends from the first pedestal 24 toward the second end 36 of the desk 20 and into the drawer space 42 that is defined between the work surface 22 and the second pedestal 28 (FIGS. 1–3, 5 and 6). The drawer 44 is provided with a drop front 46 that hinges forward and downward to provide a wrist rest 48 and to provide access to a computer keyboard and computer mouse, and the like, that may be positioned in the drawer 44. The keyboard drawer 44 may be slidably connected under the work surface 22 by any of various commonly known and readily available means, as will be understood by one having ordinary skill in the art. As is shown in drawing FIG. 2, side drawer guides 50 may be used. While in drawing FIG. 5, the drawer space 42 includes a support panel 54 and bottom mounted drawer guides 52 are used to connect the drawer 44 with the work surface 22, for example.

Figure 8:
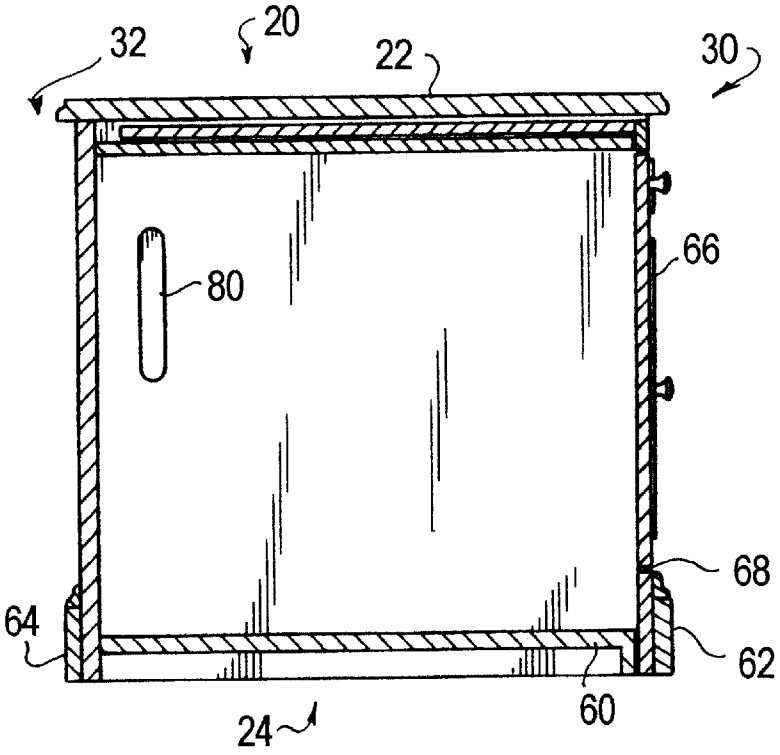
FIG. 8 is a cross-sectional view thereof, taken along line VIII—VIII of FIG. 5.
Figure 7:
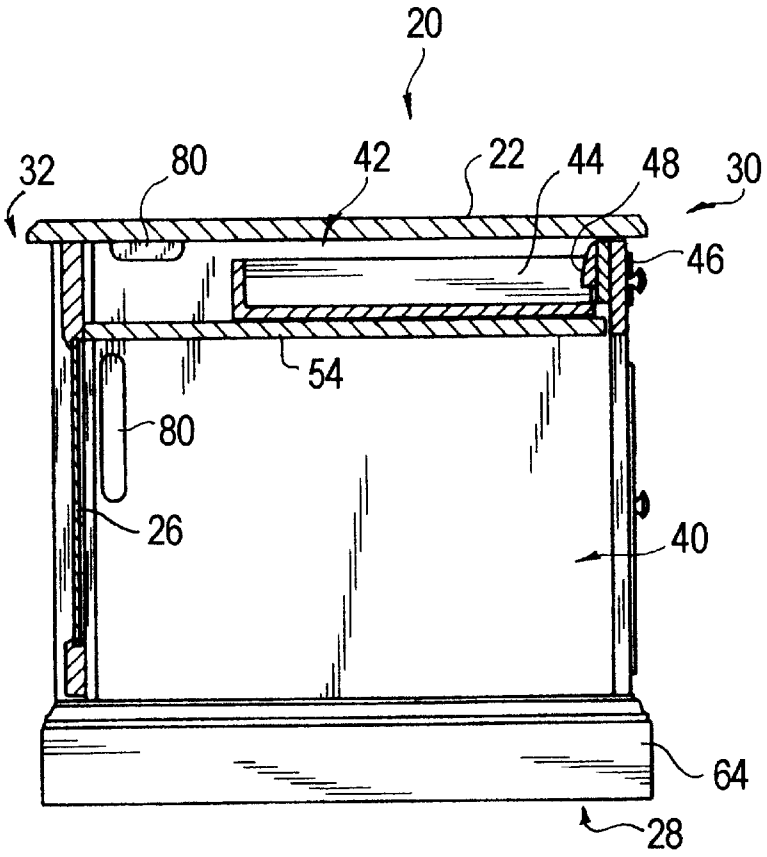
FIG. 7 is a cross-sectional view thereof, taken along line VII—VII of FIG. 5.

The first pedestal 24 has a generally open interior or storage compartment with a drop floor 60 (FIGS. 5 and 8) and a removable front kick panel 62 to facilitate installation and removal of a tower type computer central processing unit (CPU). The drop floor 60 is positioned quite low in the pedestal 24, close to the floor and in the area of the kick panel trim 64, to maximize the available vertical space between the work surface 22 and the pedestal floor 60, for a tower type CPU. The first pedestal 24 also has a door 66 that is hingedly connected with the pedestal 24 to swing between closed and open positions. The door 66 has a bottom edge 68 that is spaced from the floor, and the removable front kick panel 62 extends at least from the floor to the bottom 68 of the door 66. As will be understood by one having ordinary skill in the art, the removable front panel 62 may be fastened with screws or snap fasteners, or the like.

A saddle style storage drawer 70 (FIGS. 2 and 5) that extends from a retracted position, generally within the storage compartment, to an extended position, in which the drawer 70 extends outward from the desk front 30, may also be provided in the storage compartment of the support 24. The saddle style storage drawer 70 may be slidably connected with the first support member or pedestal 24, with side mounted drawer glides 72 as shown, for example.

The second pedestal 28 may also have a generally open interior or storage compartment with various partitions, including shelves, drawers, and equipment shelves (not shown), for example.

Further, wire way and ventilation openings 80 are provided for the passage of connectors to interconnect various computer components, and the like. The openings 80 also allow air to pass through the interiors of the pedestals 24 and 28, and around equipment that is located in the pedestals to minimize over heating of the equipment.

It will be understood by one having ordinary skill in the art and by those who practice the invention, that various modifications and improvements may be made without departing from the spirit of the disclosed concept. The scope of protection afforded is to be determined by the claims and by the breadth of interpretation allowed by law.

What is claimed is:

1. A computer desk comprising:

a work surface;

a first pedestal, the work surface and the first pedestal being integrally constructed as a unit, the first pedestal extending generally downward from the work surface, the first pedestal supporting the work surface above a floor;

a second pedestal that is a storage pedestal with an interior compartment, the second pedestal being releasably connected with and extending generally downward from the work surface, the second pedestal supporting the work surface above the floor, the second pedestal being spaced apart from the first pedestal, the second pedestal having a top that is spaced from the work surface;

a connector that releasably interconnects the second pedestal and the work surface;

a drawer space, the drawer space being at least partially defined between the second pedestal top and the work surface;

a kneehole is defined between the first and the second pedestals, the drawer space extends from over the second pedestal, over the kneehole, and at least toward the first pedestal; and a drawer that is located in the drawer space, the drawer being slidably connected with the work surface and being slidable between a closed position, generally under the work surface, and an open position, in which the drawer extends outward from a front of the desk, the drawer extending over at least each of the second pedestal and the kneehole, the drawer having a bottom panel and having a front panel that is hingedly connected with the bottom panel, the front panel hinging forward and downward from a closed position to an open position, and hinging upward and rearward from the open position to the closed position.

2. A computer desk comprising:

a work surface;

a first pedestal that is a storage pedestal with a first interior compartment, the work surface and the first pedestal being integrally constructed as a unit, the first pedestal extending generally downward from the work surface, the first pedestal supporting the work surface above a floor;

a second pedestal that is a storage pedestal with a second interior compartment, the second pedestal being releasably connected with and extending generally downward from the work surface, the second pedestal supporting the work surface above the floor, the second pedestal having a top that is spaced from the work surface and defines a drawer space therebetween;

a connector that releasably interconnects the second pedestal and the work surface;

a kneehole is defined between the first and the second pedestals, the drawer space extends from over the second pedestal, over the kneehole, and at least toward the first pedestal; and a drawer that is located in the drawer space and is slidably connected with the work surface, the drawer being slidable between a closed position, generally under the work surface, and an open position, in which the drawer extends outward from the front of the desk, the drawer extending over at least each of the second pedestal and the kneehole, the drawer having a bottom panel and having a front panel that is hingedly connected with the bottom panel, the front panel hinging forward and downward from a closed position to an open position, and hinging upward and rearward from the open position to the closed position.

* * * * *